US006029909A

United States Patent [19]

Smith

[11] Patent Number: 6,029,909

[45] Date of Patent: Feb. 29, 2000

[54] SPRAY SYSTEM WITH A DUAL INDUCTION PROCESS

[76] Inventor: William Smith, 10630-S Riggs Hill Rd., Jessup, Md. 20794

[21] Appl. No.: 09/073,239

[22] Filed: May 6, 1998

[51] Int. Cl.[7] ..... B05B 7/30

[52] U.S. Cl. ..... 239/318; 239/335; 239/340; 239/428.5

[58] Field of Search ..... 239/318, 340, 239/335, 336, 428, 428.5, 346

[56] References Cited

U.S. PATENT DOCUMENTS

| | | | |
|---|---|---|---|
| 2,230,690 | 2/1941 | Lanza | 239/428 X |
| 2,543,294 | 2/1951 | McCabe | 239/428.5 X |
| 2,719,704 | 10/1955 | Anderson et al. | 239/335 X |
| 2,724,583 | 11/1955 | Targosh et al. | 239/335 X |
| 3,797,747 | 3/1974 | Buzzi et al. | 239/335 X |
| 4,850,809 | 7/1989 | Smith | 417/190 |
| 5,058,807 | 10/1991 | Smith | 239/302 |
| 5,186,388 | 2/1993 | Chapman et al. | 239/336 X |
| 5,271,564 | 12/1993 | Smith | 239/532 |
| 5,393,345 | 2/1995 | Smith | 118/312 |
| 5,609,302 | 3/1997 | Smith | 239/526 |
| 5,697,361 | 12/1997 | Smith | 128/204.25 |

OTHER PUBLICATIONS

Dr. Kwok & Dr. Liu, "How Atomization Affects Transfer Efficiency".
Industrial Finishing Magazine, May 1992.

*Primary Examiner*—Lesley D. Morris

*Attorney, Agent, or Firm*—Tom Hamill, Jr.

[57] ABSTRACT

A dual induction apparatus for high volume low pressure spraying systems is provided. The invention includes an atomizing tube with an entrance, a midpoint and an exit. A jet nozzle is connected to the entrance of the atomizing tube. A first plurality of induction ports pass through the sidewalls of the atomizing tube proximal the jet nozzle. The first plurality of induction ports are in communication with ambient air. When the compressed air passes through the jet nozzle a low pressure field is formed causing ambient air to be drawn into the atomizing tube. A venturi element is located inside the atomizing tube in the area about the midpoint to the exit. A tube in communication with the removable venturi element is passed through the sidewall of the atomizing tube. The tube is affixed in a perpendicular fashion to the aperture in the venturi element on its first side and is further connected to a reservoir of paints, powders, solvents or other substances. The tube may be mated to the atomizing tube in a removable sliding lock fashion. By the prior action of compressed air passing through the jet nozzle the low pressure field is formed and is maintained with ambient air having been inducted into the atomizing tube through the first plurality of ports. The pressure at the midpoint of the atomizing tube is also sufficiently low to cause a suction through the tube drawing the atomizable substance from its reservoir into the cylindrical element located along the centerline of the atomizing tube. The liquid drawn through the tube and into the cylindrical element is entrained and atomized into the low pressure air. At this point the atomized substance passes through the atomizing tube exit where it is delivered to its target.

15 Claims, 4 Drawing Sheets

SPRAY SYSTEM WITH A DUAL INDUCTION PROCESS

BACKGROUND OF THE INVENTION

Field of the Invention

The present invention relates generally to spraying systems, and more particularly, to a simplified dual induction apparatus to be employed in the atomizing tube of a spraying system.

SUMMARY OF THE INVENTION

To achieve the foregoing and other advantages, the present invention, briefly described, provides a dual induction apparatus for high volume low pressure spraying systems. The use of the dual induction apparatus in the spraying system will significantly reduce air pollution associated with overspray of paints, powders, solvents and other substances as well as increase transfer efficiency. The invention includes an atomizing tube with an entrance, a midpoint and an exit. A jet nozzle is connected to the entrance of the atomizing tube. A first plurality of induction ports pass through the sidewalls of the atomizing tube proximal the jet nozzle. The first plurality of induction ports are in communication with ambient air. When the compressed air passes through the jet nozzle a low pressure field is formed causing ambient air to be drawn into the atomizing tube. A second port is passed through the sidewall of the atomizing tube about its midpoint. A hollow cylindrical element is provided along the horizontal centerline of the atomizing tube above the second port. The cylindrical element includes a venturi configuration and is slidingly affixed to the atomizing tube by sliding the cylindrical element into the atomizing tube along a L-shaped aperture in the atomizing tube. The cylindrical element further includes an aperture through the cylindrical element sidewall at its midpoint. The cylindrical element includes a tube affixed in a perpendicular fashion to the aperture in the cylindrical element on the tubes's first side and is further connected to the second port on the tube's second side. The tube is slidingly mated to the atomizing tube where in a sliding lock fashion, and the tube is further in communication with a reservoir of paints, powders, solvents or other substances.

By the prior action of compressed air passing through the jet nozzle the low pressure field is formed and is maintained with ambient air having been inducted into the atomizing tube through the first plurality of ports. The pressure at the midpoint of the atomizing tube is sufficiently low to cause a suction through the tube drawing the paint, powder, solvent or the like from its reservoir into the cylindrical element located along the centerline of the atomizing tube. The liquid drawn through the tube and into the cylindrical element is entrained and atomized into the low pressure air. At this point the atomized paint, powder, solvent or other substances pass through the atomizing tube exit where it is delivered to its target.

It is to be understood that the horizontal tube may include a venturi configuration.

In an additional embodiment of the instant invention, a venturi configuration will also be located in an atomizing tube, downstream from a jet nozzle and induction ports, however, in this embodiment, the venturi configuration is integral to the atomizing tube, and has a port which passes through the sidewall of the atomizing tube. A tube passes through the port and connects the midpoint of the venturi configuration to a reservoir of the paint, powder, solvent or the like. Again, due to the action of the jet nozzle and the inducted air, a low pressure field is formed, and as the air passes through the venturi configuration the pressure at the midpoint of the venturi portion of the atomizing tube is still sufficiently low to cause a suction through the tube drawing the paint, powder, solvent or the like from its reservoir into the venturi configuration located downstream of the atomizing tube.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a spray system with a dual induction process which introduces a second suctioning effect by employing the energy of the inducted and residual compressor air, such air passing through a venturi shape causing a suction sufficient to draw a liquid out a container which is to be further delivered to a target.

It is therefore an object of the present invention to provide a spray system with a dual induction process which significantly controls overspray of errant particles.

It is therefore an object of the present invention to provide a spray system with a dual induction process which has low upstream compressor requirements.

It is therefore an object of the present invention to provide a spray system with a dual induction process which is easy to clean by having an easily attachable as well as easily removable horizontal tube with a venturi configuration from the atomizing tube, the removable horizontal tube being simply replaced with a fresh horizontal tube, while the used horizontal tube may be cleaned, recycled or disposed of.

It is therefore an object of the present invention to provide a spray system with a dual induction process which enhances the efficiency of the internal atomization.

It is another object of the present invention to provide a spray system with a dual induction process which may permit the quick and easy exchange of fluid nozzles which permits atomization of fluids, powders, solvents and the like at any substance viscosity.

It is another object of the present invention to provide a spray system with a dual induction process which may be easily, inexpensively, efficiently manufactured and marketed.

It is a further objective of the present invention to provide a spray system with a dual induction process which is of durable and reliable construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a spray system with a dual induction process embodying the principles and concepts of the present invention will be described.

Figure 1:
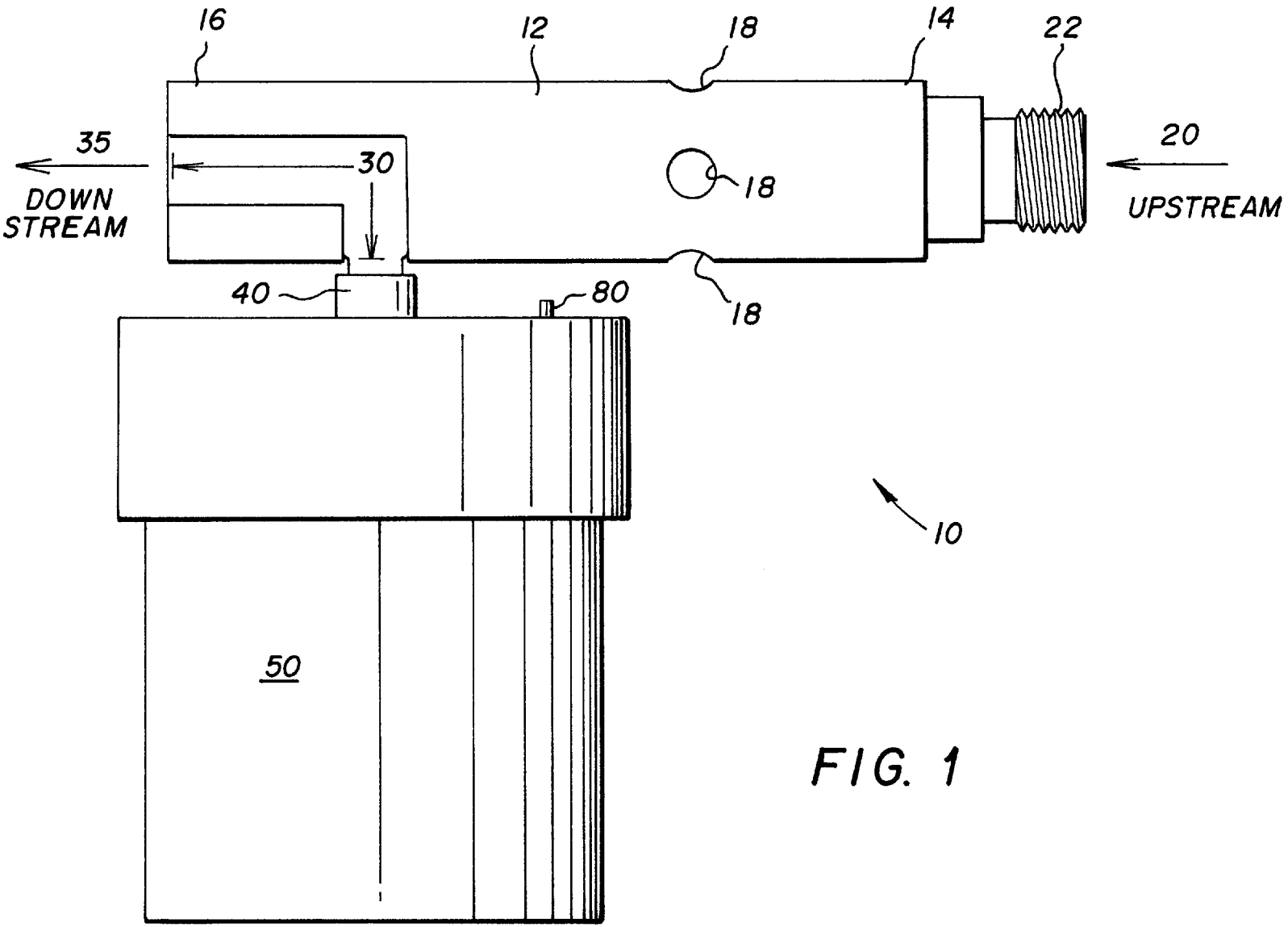
FIG. 1 is a perspective view showing the first preferred embodiment of the spray system with a dual induction process of the invention.

Turning initially to FIG. 1, a first embodiment of the spray system 10 with dual induction ports is shown. In its preferred form, the spray 10 system with dual induction ports includes an atomization tube 12 with a downstream portion 16 and an upstream portion 14. The atomization tube 12 has a first circumference which is constant along its length. Threading 22 is designed to be affixed to a hose or other air transport means between the atomization tube and a small compressor. A plurality of first induction ports 18 pass through the wall of the atomization tube 12. These first induction ports 18 are proximal the exit of a jet nozzle (best seen in FIG. 7). As compressed air (Arrow 20) from a small air compressor passes through the jet nozzle, several air properties are changed as the air passes through the jet nozzle. First, a low pressure field is formed, second, air velocity is increased, third, temperature is reduced and fourth, humidity is reduced. As a result of the low pressure field which forms proximal the exit of the jet nozzle, ambient air is inducted through induction ports 18. This is the first air induction of the dual induction process.

A reservoir 50 is affixed to a mating element 40 by any of a variety of conventional methods. The mating element 40 is shown in more detail in FIG. 3. The reservoir 50 may hold paints, solvents, powders, pigments, coatings, or any material which is conventionally or perhaps unconventionally sprayed. An L-shaped cutout 30 is located proximal the downstream portion of the atomization tube 12. Cutout 30 is designed to receive the mating portion of a horizontal tube 55 best seen if FIG. 3. Arrow 35 represents the exiting atomized material which will be delivered to target.

Figure 2:
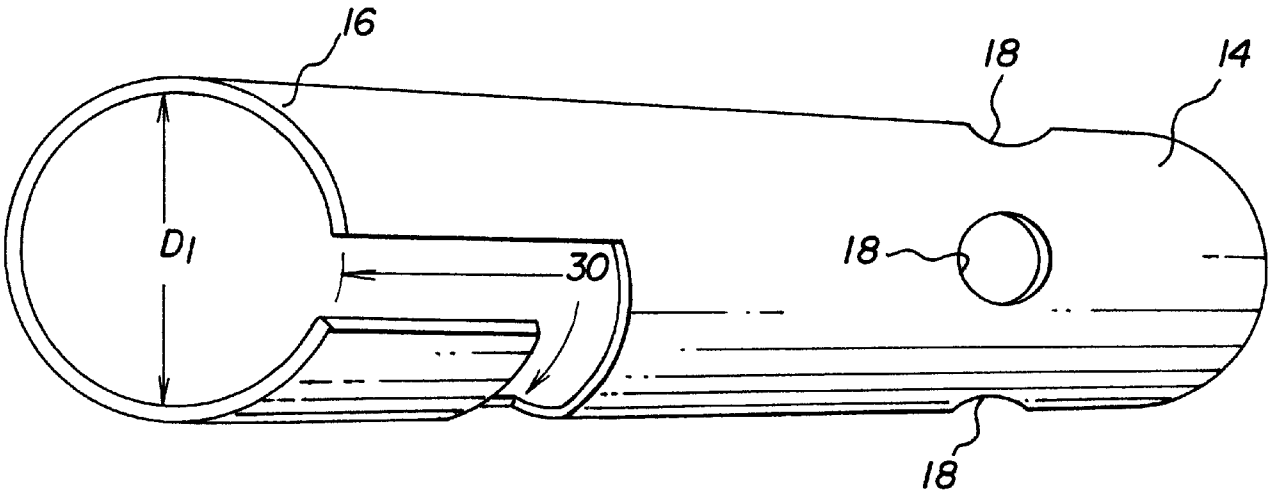
FIG. 2 is a view of the atomizing tube showing the L-shaped aperture on the downstream side of the atomizing tube as well as the plurality of ambient air induction ports on the upstream of the atomizing tube.

FIG. 2 is a view of the atomizing tube 12 showing the general arrangement of the L-shaped cutout 30 and the first air induction ports 18. It also clearly shows the first diameter designated D1.

Figure 3:
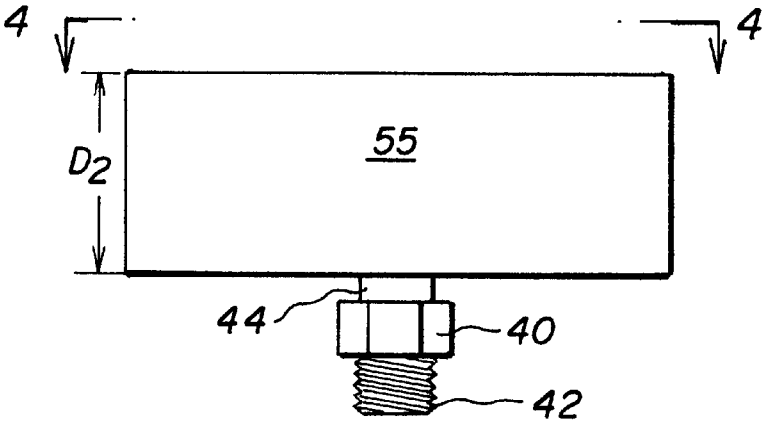
FIG. 3 is a side view of the horizontal tube insert which will be placed in a nested relation into the opening on the downstream side of the atomizing tube.

FIG. 3 is a view describing the horizontal tube 55. A small cylindrical element 44 is located intermediate horizontal tube 55 and mating element 40. The diameter of the horizontal tube 55 is designated as D2. The diameter D2 of the horizontal tube 55 is designed to be less than that of the diameter D1 of the atomizing tube 12. Horizontal tube 55 is designed to be received in the downstream end of the atomizing tube 12 with the small cylindrical element 44 positively engaging the L-shaped cutout 30 and sliding along its length, and then locking into a final position by a second downward sliding of between 70 and 100 degrees of arc. This action may be reversed and the horizontal tube 55 may be easily removed. The interfit between the atomizing tube 12 and the horizontal tube 55 will be closely toleranced. This will channel the air through the horizontal tube 55, due to the fact that the horizontal tube's sidewall essentially forms a sidewall which blocks the L-shaped cutout 30 on the atomizing tube 12. Threading 42 is designed to permit the horizontal tube 55 to be affixed to the reservoir 50.

Figure 4:
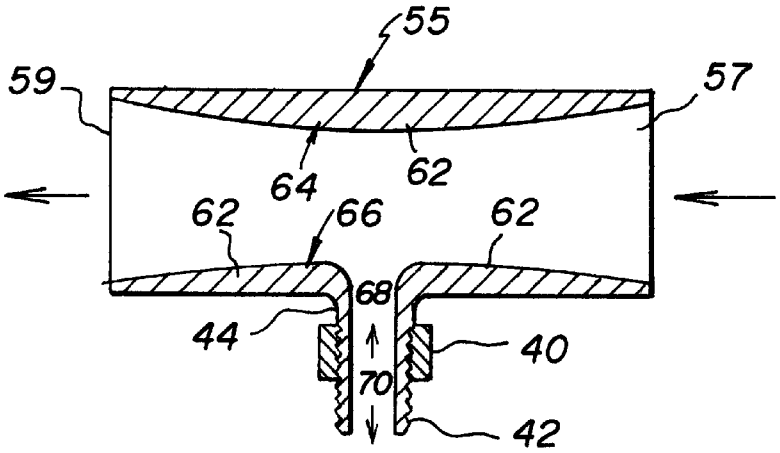
FIG. 4 is a cross-sectional view of the horizontal tube insert of FIG. 3 taken along line 4—4 thereof, showing a possible venturi configuration of the interior of the horizontal tube.

Referring now specifically to FIG. 4, a cutaway view of FIG. 3 is provided, showing the internal structure of the horizontal tube 55 and its ancillary portions. Horizontal tube 55 has an entry 57 and an exit 59. The interior wall of horizontal tube 55 has a venturi shape 62 with a top portion 64 and a bottom portion 66. An aperture 68 is located at the midpoint of the bottom portion of the venturi shape 62. Aperture 68 is the second induction port 68 of the dual induction spray system 10 described herein. Second induction port 68 is located above and in communication with a tubular element 70 which passes through small cylindrical element 44, mating element 40 and threading 42. When threading 42 is affixed to reservoir 50 the second induction port is in communication with the reservoir 50 itself. Reservoir 50 includes a small aperture 80 located on its top which brings the contents located therein to ambient pressure. The pressure at the midpoint of the horizontal tube 55 is also sufficiently low to induct material from the reservoir 50 into the horizontal tube 55 where the material becomes atomized. The atomized material then exits the atomization tube 12 and is delivered to target. Horizontal tube 55 may be chosen to be any of a variety of shapes and configurations in order to accommodate materials of different viscosities and material properties. These include paints, pigments, powders, thick roof tar, thin solvents, etc.

Figure 5:
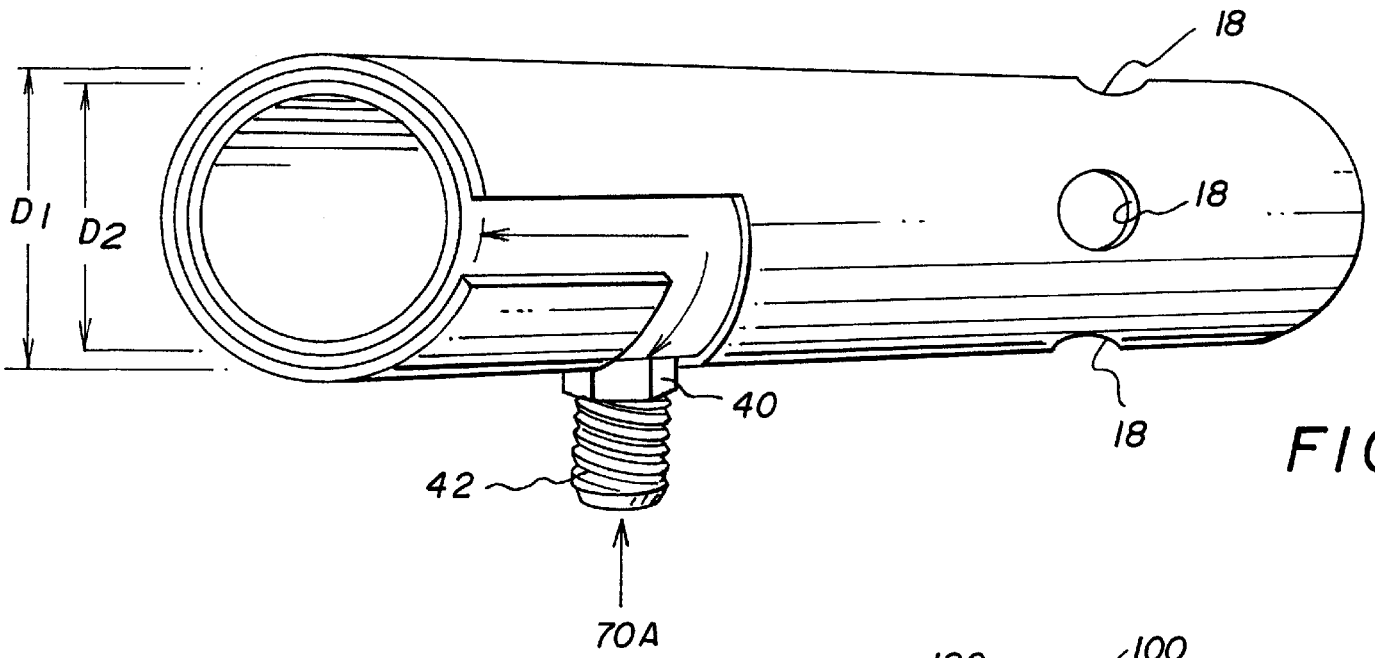
FIG. 5 is a view of the atomizing tube with the horizontal tube insert in place, shown in it's final locked position in the L-shaped aperture located on the downstream portion of the atomizing tube.

FIG. 5 shows the horizontal tube 55 fully mounted within the atomizing tube 12. Note the location of the first induction ports 18 upstream of the second induction port which is indicated by arrow 70 below the tubular element which brings the aperture 68 into communication with that point. The difference between the diameters D1 and D2 are also pointed out.

Figure 6:
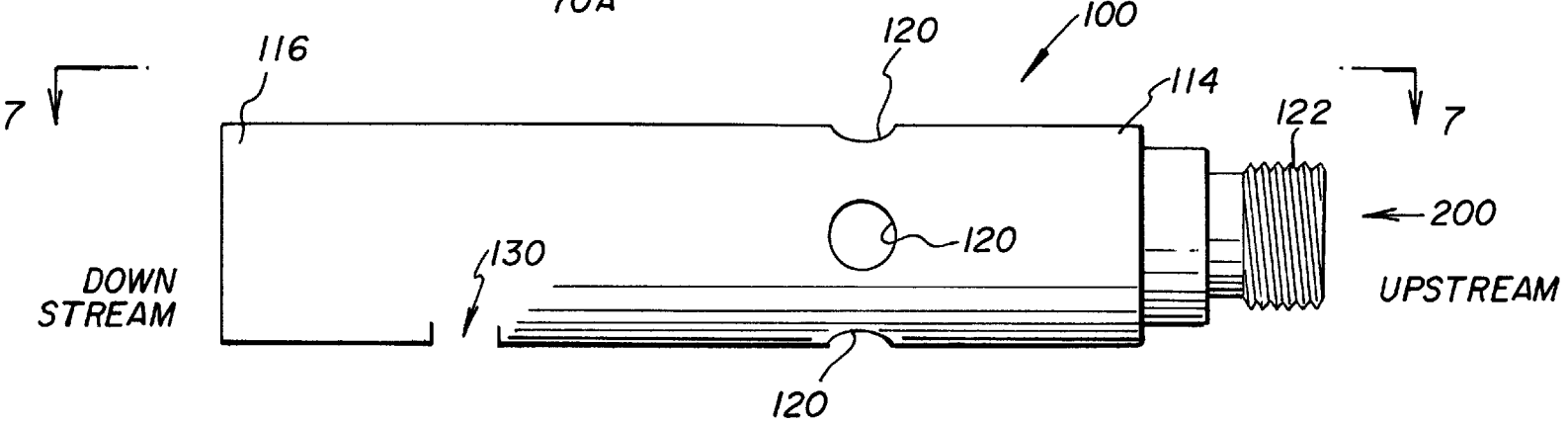
FIG. 6 is a side view of a second embodiment of the spray system with a dual induction process.
Figure 7:
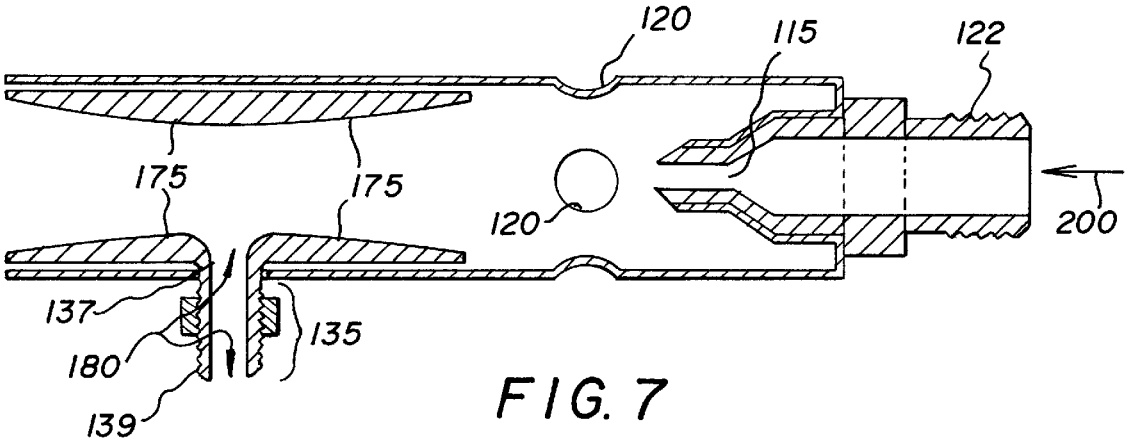
FIG. 7 is a cross sectional view of FIG. 6 taken along line 7—7 showing from right to left, an upstream entrance, a jet nozzle, a plurality of induction ports, a venturi configuration, a second induction port located at the midpoint of the venturi and a downstream exit.

Referring now to FIGS. 6 and 7 a second embodiment of the instant invention is shown. FIG. 6 shows the exterior of the atomization tube 100 with first air induction ports 120. The atomization tube 100 includes a upstream portion 114 and an downstream portion 116. Threading 122 designed to be affixed to a hose or other air transport means between the atomization tube and a small compressor. A plurality of first induction ports 120 pass through the wall of the atomization tube 100. These first induction ports 120 are proximal the exit of a jet nozzle 115. As compressed air (Arrow 200) from a small air compressor passes through the jet nozzle 115, several air properties are changed as the air passes through the jet nozzle 115. First, a low pressure field is formed, second, air velocity is increased, third, temperature is reduced and fourth, humidity is reduced. As a result of the low pressure field which forms proximal the exit of the jet nozzle 115, ambient air is inducted through induction ports 120. This is the first air induction of the dual induction process. A second air induction port 130 is located downstream on the atomization tube 100 and is tapped to threadably receive adapter element 135. This is the second induction of the dual induction spray process. Adapter element 135 is threaded on its first side 137 and on its second side 139.

Figure 8:
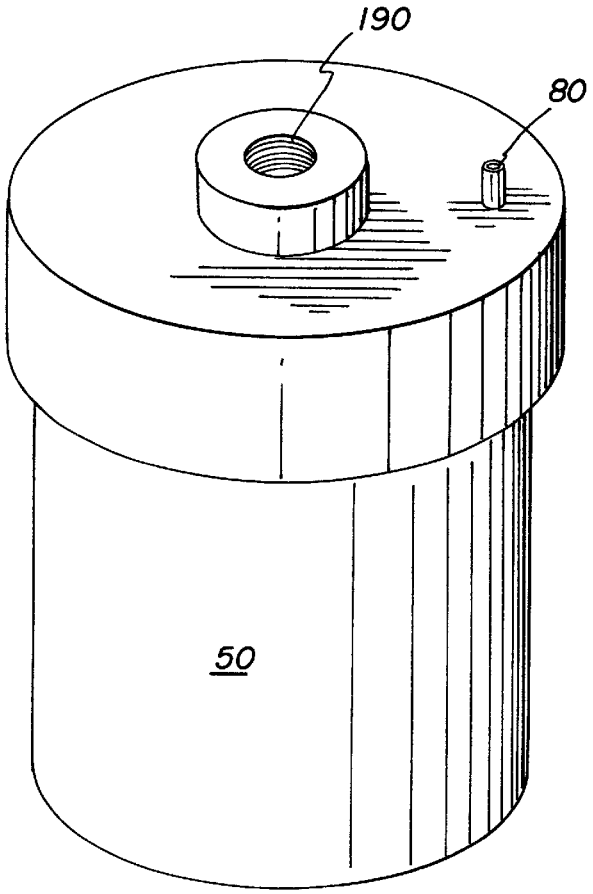
FIG. 8 shows the reservoir or container for paints, solvents, powders, pigments, or the like, with a central connection port which could be attached to either embodiment of the instant invention.

Referring now to the cross section shown in FIG. 7, the venturi element 175 is shown downstream from the first air induction ports 120 and the jet nozzle 115. It is noted that the adapter element 135 is designed to be inserted at about the middle of the venturi element 175. A passage 180 passes through the center of the adapter element 135. Passage 180 will place the center of the venturi element 175 in communication with the reservoir 50 when the reservoir is affixed to the threading on the second side of the adapter element 135. The threading 139 on the second side of the adapter element 135 is designed to be attached to the mating element 190 on the reservoir 50. Reservoir 50 details are seen most clearly in FIG. 8. A small opening 80 is located on the top of the reservoir permitting the contents located therein to be at ambient pressure. The pressure at the midpoint of the venturi element 175 is also sufficiently low to induct material from the reservoir 50 into the venturi element 175 where the material becomes atomized. The atomized material then exits the venturi element 175 where it is delivered to target.

It is apparent from the above that the present invention accomplishes all of the objectives set forth by providing a spray system with a dual induction process which introduces a second suctioning effect by employing the energy of the inducted and residual compressor air, such air passing through a venturi shape causing a suction sufficient to draw a liquid out a container which is to be further delivered to a target, said spray system with the dual induction process further significantly controlling the overspray of errant particles.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A spray system with a dual induction process comprising:

an atomizing tube, said atomizing tube generally cylindrical and hollow, including sidewalls, as well as an atomizing tube entrance and an atomizing tube exit, a jet nozzle, said jet nozzle residing within said atomizing tube proximal said entrance, said nozzle having a nozzle entrance and a nozzle exit, a plurality of induction ports, said induction ports passing through said sidewalls, said induction ports further in communication with a region proximal said jet nozzle exit, a removable venturi element, said venturi element being downstream of said jet nozzle and residing within said atomizing tube, said venturi element including an aperture, said aperture passing through said sidewalls and is in communication with a reservoir of material, whereby a low power compressor provides compressed air to said jet nozzle, as the compressed air passes through said jet nozzle the air's pressure is reduced, thereby causing air to be inducted through said plurality of induction ports, the air continues to travel through said venturi element where the pressure remains low enough to induct said material from said reservoir into said venturi element where said material is atomized and further propelled to said atomizing tube exit where it is delivered to the target.

2. A spray system with a dual induction process as claimed in claim 1 wherein said sidewalls include a L-shaped cutout, said L-shaped cutout beginning at said atomizing tube exit and terminating prior to said plurality of induction ports.

3. A spray system with a dual induction process as claimed in claim 2 wherein said venturi element includes a tube affixed perpendicularly to said venturi element proximal said venturi element's midpoint, said tube having a channel centrally located within said tube, said channel in communication with said venturi element.

4. A spray system with a dual induction process as claimed in claim 3 wherein said tube has a first side and a second side, said first side being connected to said venturi element.

5. A spray system with a dual induction process as claimed in claim 4 wherein said tube slidingly engages said L-shape cutout, with said venturi element residing inside said atomizing tube and said second side residing outside of said atomizing tube.

6. A spray system with a dual induction process as claimed in claim 5 wherein said second side of said tube includes mating means.

7. A spray system with a dual induction process as claimed in claim 6 wherein said mating means are connected to said reservoir.

8. A spray system with a dual induction process as claimed in claim 1 wherein said material is selected from the group consisting of powders, pigments, solvents, paints, lubricants, coatings, fuels, pesticides, organic compounds, and atomizable materials.

9. A high volume low pressure spray system with a dual induction process comprising:

an atomizing tube, said atomizing tube being generally cylindrical and hollow, including sidewalls, as well as an atomizing tube entrance and an atomizing tube exit, a jet nozzle, said jet nozzle residing within said atomizing tube proximal said entrance, said nozzle having a nozzle entrance and a nozzle exit, a plurality of induction ports, said induction ports passing through said sidewalls, said induction ports further in communication with a region proximal said jet nozzle exit, a removable venturi element, said venturi element being downstream of said jet nozzle and residing within and integral with said atomizing tube, said venturi element including an aperture, said aperture passing through said sidewalls and further is in communication with a reservoir of material, whereby a low power compressor provides compressed air to said jet nozzle, as the compressed air passes through said jet nozzle the air's pressure is reduced, thereby causing air to be inducted through said plurality of induction ports, the air continues to travel through said venturi element where the pressure remains low enough to induct said material from said reservoir into said venturi element where said material is atomized and further propelled to said atomizing tube exit where it is delivered to the target.

10. A spray system with a dual induction process as claimed in claim 9 wherein a tube is designed to be mated with the aperture, said tube having a first side and a second side.

11. A spray system with a dual induction process as claimed in claim 10 wherein said first side is threadably mated with said aperture.

12. A spray system with a dual induction process as claimed in claim 11 wherein said second side is threaded.

13. A spray system with a dual induction process as claimed in claim 12 wherein said second side is threadably mated with said reservoir.

14. A spray system with a dual induction process as claimed in claim 9 wherein said material is selected from the group consisting of powders, pigments, solvents, paints, lubricants, coatings, fuels, pesticides, organic compounds, and atomizable materials.

15. A spray system with a dual induction process comprising:

an atomizing tube, said atomizing tube being generally cylindrical and hollow, including sidewalls, as well as an atomizing tube entrance and an atomizing tube exit, said sidewalls including a L-shaped cutout, said L-shaped cutout beginning at said atomizing tube exit, a jet nozzle, said jet nozzle residing within said atomizing tube proximal said entrance, said nozzle having a nozzle entrance and a nozzle exit, a plurality of induction ports, said induction ports passing through said sidewalls, said induction ports further in communication with a region proximal said jet nozzle exit, a venturi element, said venturi element including a tube, said tube slidingly received within said L-shaped cutout to a position where said venturi element is residing within said atomizing tube, said venturi element being downstream of said jet nozzle said tube further in communication with a reservoir of atomizable material, whereby a low power compressor provides compressed air to said jet nozzle, and as the compressed air passes through said jet nozzle the air's pressure is reduced, thereby causing air to be inducted through said plurality of induction ports, the air continues to travel through said venturi element where the pressure remains low enough to induct said material from said reservoir into said venturi element where said material is atomized and further propelled to said atomizing tube exit where it is delivered to the target.

* * * * *